United States Patent [19]

Otsuka et al.

[11] Patent Number: 4,772,319

[45] Date of Patent: Sep. 20, 1988

[54] PROCESS FOR TREATING MOLTEN ALUMINUM TO REMOVE HYDROGEN GAS AND NON-METALLIC INCLUSIONS THEREFROM

[75] Inventors: Ryotatsu Otsuka, Osaka; Shigemi Tanimoto; Kazuo Toyoda, both of Izumi, Japan

[73] Assignee: Showa Aluminum Corporation, Sakai, Japan

[21] Appl. No.: 910,574

[22] Filed: Sep. 23, 1986

[30] Foreign Application Priority Data

Sep. 27, 1985 [JP] Japan ..... 60-216023

[51] Int. Cl.[4] ..... C22B 21/00

[52] U.S. Cl. ..... 75/68 R; 55/53

[58] Field of Search ..... 55/53, 247, 72, 256; 261/87, 93; 209/169, 170; 175/68 R

[56] References Cited

U.S. PATENT DOCUMENTS

| | | | |
|---|---|---|---|
| 3,229,446 | 1/1966 | Sebastian et al. | 55/53 |
| 3,257,777 | 6/1966 | Weisse | 55/72 |
| 3,870,511 | 3/1975 | Szekely | 75/68 R |
| 3,917,242 | 11/1975 | Bass et al. | 75/68 R |
| 4,052,199 | 10/1977 | Mangalick | 75/68 R |
| 4,392,888 | 7/1983 | Eckert et al. | 75/68 R |
| 4,556,419 | 12/1985 | Otsuka et al. | 75/68 R |

FOREIGN PATENT DOCUMENTS

| | | | |
|---|---|---|---|
| 149735 | 8/1985 | Japan | 75/68 R |
| 135537 | 7/1987 | Japan | 75/68 B |
| 659674 | 3/1963 | Canada | 75/68 R |

OTHER PUBLICATIONS

Removing Freon Gas from Hydraulic Fluid, p. 452, Nasa Tech. Brief, 1980 (winter).

*Primary Examiner*—Bernard Nozick

*Attorney, Agent, or Firm*—Armstrong, Nikaido, Marmelstein & Kubovcik

[57] ABSTRACT

Hydrogen gas and non-metallic inclusions are removed from molten aluminum by a process comprising the steps of rendering the portion above the surface of molten aluminum in a treating vessel where the molten aluminum is placed, an atmosphere of air having a lower dew point than that of the atmosphere and maintaining it as it is, introducing a treating gas into the molten aluminum, and removing floating non-metallic inclusions and treating gas containing hydrogen gas from the surface of the melt.

6 Claims, 3 Drawing Sheets

PROCESS FOR TREATING MOLTEN ALUMINUM TO REMOVE HYDROGEN GAS AND NON-METALLIC INCLUSIONS THEREFROM

BACKGROUND OF THE INVENTION

The present invention relates to a process for treating molten aluminum to remove hydrogen gas and non-metallic inclusions from the melt.

The term "aluminum" as used herein and in the appended claims includes pure aluminum and all aluminum alloys. Further the term "inert gas" used includes argon gas, helium gas, krypton gas and xenon gas on the Periodic Table and nitrogen gas which is inert to aluminum.

Molten aluminum before casting contains dissolved hydrogen gas and non-metallic inclusions, such as oxides of aluminum and magnesium, as undesirable impurities. Hydrogen gas and non-metallic inclusions, when present in molten aluminum, could produce defects in the ingots prepared from the melt and also in the products prepared from the ingot. Accordingly hydrogen gas and non-metallic inclusions must be removed from the molten metal.

Hydrogen gas and non-metallic inclusions are removed from molten aluminum usually by introducing an inert gas or chlorine gas into the molten metal in the form of bubbles. However, since the atmosphere contains water (in an amount of up to about 30 mg/liter in summer in Osaka, Japan), aluminum and the water in the atmosphere react on the surface of the molten metal ($2Al+3H_2O \rightarrow Al_2O_3+3H_2$), giving rise to the problem that the resulting hydrogen penetrates into the melt. The surface of molten aluminum which is allowed to stand is usually covered with a compact aluminum oxide coating, so that the water in the atmosphere will not react with aluminum. Nevertheless, when a treating gas, such as an inert gas or chlorine gas, is forced into molten aluminum, the bubbles released to float on the surface of the melt disturb the surface and break the aluminum oxide coating over the melt surface, exposing the melt to the atmosphere at the broken portion. The water in the atmosphere then reacts with aluminum before a fresh oxide coating is formed at the broken portion, producing hydrogen gas and permitting the gas to penetrate into the melt.

Accordingly another process has been proposed in which a treating vessel of closed construction is used for containing molten aluminum, an inert gas is filled into the vessel above the surface of the molten aluminum placed therein, and a treating gas is introduced into the melt while maintaining the gas atmosphere at a pressure higher than atmospheric pressure (U.S. Pat. No. 3,870,511). This process, however, requires a large amount of inert gas and therefore costs high.

SUMMARY OF THE INVENTION

An ojbect of the present invention is to provide a process for removing hydrogen gas and non-metallic inclusions for molten aluminum by introducing a treating gas into the molten aluminum wherein the water content in an atmosphere above the surface of the molten aluminum is reduced to decrease the amount of hydrogen gas resulting from the reaction between the aluminum and the water in said atmosphere with the result of achieving an improved hydrogen gas removal efficiency.

Another object of the invention is to provide a process which does not involve the necessity of using an expensive inert gas and which can therefore be practiced at a low expense.

The process of this invention for treating molten aluminum to remove hydrogen gas and non-metallic inclusions therefrom comprises the steps of rendering the portion above the surface of molten aluminum in a treating vessel where the molten aluminum is placed, an atmosphere of air having a lower dew point than that of the atmosphere and maintaining it as it is, introducing a treating gas into the molten aluminum, and removing floating non-metallic inclusions and treating gas containing hydrogen gas from the surface of the melt.

According to this process, the water content in an atmosphere above the surface of the molten aluminum placed in the treating vessel is reduced to remarkably inhibit the water from reacting with the aluminum, whereby the amount of the hydrogen gas resulting from the reaction is decreased to achieve an improved hydrogen gas removal efficiency. In addition, this invention can be practiced without using such an expensive inert gas as conventionally required.

Air of a lower dew point than that of the atmosphere, which is utilized during the treatment, is obtained, for example, by compressing the atmosphere with a compressor and passing the compressed air through a dehumidifier containing a drying agent. The dew point of the obtained air is preferably below −30° C., but this value is not limitative. Any known drying agents are employable as the drying agent to be placed in the dehumidifier. Among others, synthetic zeolite is preferable. Further, in the case where the treated molten aluminum is used for producing magnetic discs, photosensitive drums, bonding wires, rotary polygon mirrors for laser beam printer or the like instruments; particle accelerating pipes for synchrotron; vacuum equipments for thin-film preparing apparatuses, surface analyzers, nuclear fusion apparatuses and the like; aluminum foils of high purity; and air crafts or the like, the hydrogen gas content in the treated melt is preferably, for example, about 0.10 cc/100.Al. It is preferably about 0.05 cc/100g.Al especially for producing particle accelerating pipes. In these cases the dew point of the atmosphere (air) in the treating vessel is preferably adjusted to be below −50° C.

The portion above the surface of the molten aluminum in the treating vessel is rendered to be an atmosphere of air having a lower dew point than that of the atmosphere and maintained as it is, practically, for example, by continuously or intermittently supplying said air into said atmosphere from the outside during the treating procedures and further enhancing the airtightness of the treating vessel so as not to let the atmosphere enter the treating vessel as much as possible.

Useful treating gases which are to be introduced into molten aluminum are various gases, such as inert gases and chlorine gas, which are usually used for removing hydrogen gas and non-metallic inclusions from molten metals.

The hydrogen within the molten aluminum diffuses through the bubbles of treating gas and is entrained therein when these bubbles move upward through the melt to the surface thereof, whereupon the hydrogen gas is released to the atmosphere. The non-metallic inclusions in the molten aluminum are carried to the dross layer over the surface of the molten metal by the bubbles of treating gas. The hydrogen-containing treating gas released into the atmosphere and the dross containing the non-metallic inclusions on the melt surface are removed by a suitable known method. The process of the invention is almost comparable to the conventional process in the efficiency to remove the non-metallic inclusions.

The invention will be described in greater detail with reference to the accompanying drawings.

DESCRIPTION OF THE PREFERRED EMBODIMENTS

Figure 1:
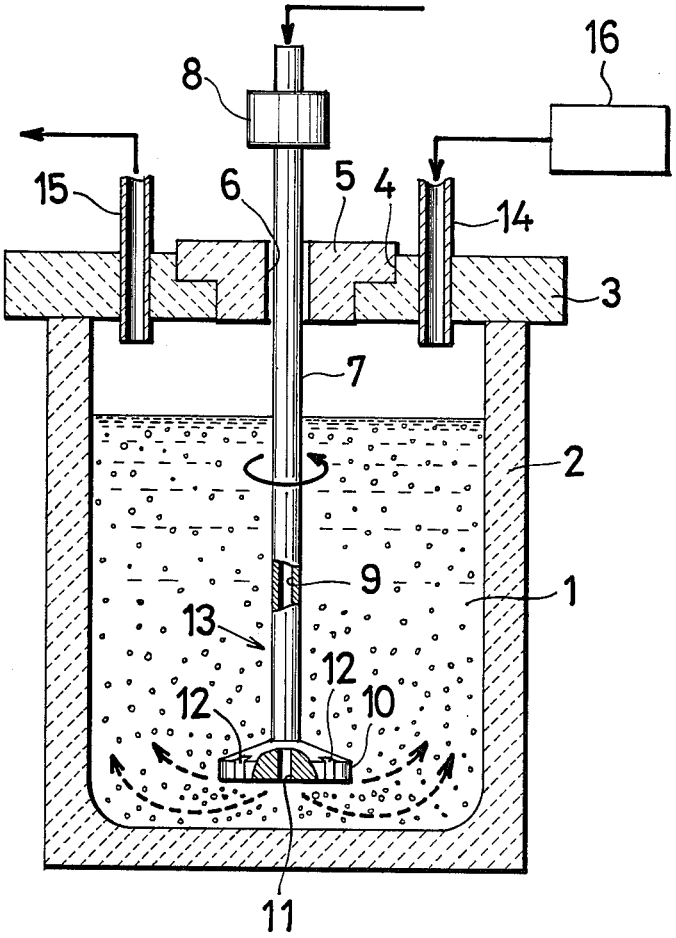
FIG. 1 is a view in vertical section showing an embodiment of apparatus for use in practicing the process of the invention for treating molten aluminum.

With reference to FIG. 1 showing an embodiment for use in treating molten aluminum according to the invention, the molten aluminum 1 to be treated and containing hydrogen gas and non-metallic inclusions is placed in a treating vessel 2 to a level slightly below the upper end of the vessel 2. The vessel 2 has an upper-end opening which is closed with a lid 3. The lid 3 is centrally formed with a hole 4, which is closed with a removable plug 5. The hole 4 is so sized as to permit the rotor 10 to be described later to pass therethrough. The plug 5 has a central bore 6, through which a rotary shaft 7 passes. The rotary shaft 7 is arranged to be rotated by a motor 8. The rotary shaft 7 is internally provided with a treating gas supply channel 9 vertically extending therethrough. The upper end of the channel 9 is in communication with an unillustrated device for supplying treating gases. The rotary shaft 7 has a lower end portion extending close to the bottom of the treating vessel 2, to which portion the rotor 10 is fixed at the front end thereof. The rotor 10 is centrally formed at its bottom surface with an outlet 11 for blowing off the treating gas, which is in communication with the treating gas supply channel 9 at the upper end thereof. The rotor 10 is provided with a plurality of vertical grooves 12 circumferentially spaced apart from each other by a predetermined distance on its peripheral surface. The upper end of each vertical groove 12 is opened into the upper surface of the rotor 10 while its lower end into the lower surface of the latter. The rotary shaft 7 and the rotor 10 constitute a device 13 for introducing treating gases. At the right side of the hole 4, a pipe 14 for supplying air lower than the atmosphere in dew point fixedly extends through the lid 3. The supply pipe 14 is connected to the dehumidifier 16. The dehumidifier 16 contains a drying agent (not shown) comprising synthetic zeolite. At the left side of the hole 4, a vent pipe 15 is fixedly inserted through the lid 3. The vent pipe 15 is provided to take out the atmosphere originally present in the treating vessel, which is to be expelled from within the treating vessel 2 by the lower dew-point air to be supplied into the treating vessel 2 through the supply pipe 14 before starting to practice the treating process of the invention. The vent pipe 15 also serves to let out excess of the lower dewpoint air to be fed into the treating vessel 2 during the treating prodecures as well as excess of the treating gas, from within the treating vessel 2. The supply pipe 14 and the vent pipe 15 each have a lower end positioned above the surface of the molten aluminum.

With the apparatuses described, air of a lower dew point than that of the atmosphere is supplied through the supply pipe 14 from the lower dew-point air supply device 16 to the portion above the surface of the molten aluminum placed in the treating vessel, thereby rendering said portion an atmosphere filled with the lower dew-point air. Thereafter, a treating gas is forced into the molten aluminum 1 from the outlet 11 while the shaft 7 is being axially rotated by the motor 8 to rotate the rotor 10. The gas is supplied from the treating gas supply device to the outlet 11 through the channel 9. The gas is supplied further from the lower-end opening of the outlet 11 to the bottom of the rotor 10. By the centrifugal force resulting from the rotation of the rotor 10 and the action of the vertical grooves 12, the treating gas is released in the form of fine bubbles from the periphery of the rotor 10 so as to diffuse through the entire mass of the molten aluminum 1.

Examples 1–4 and Comparison Example 1

Figure 2:
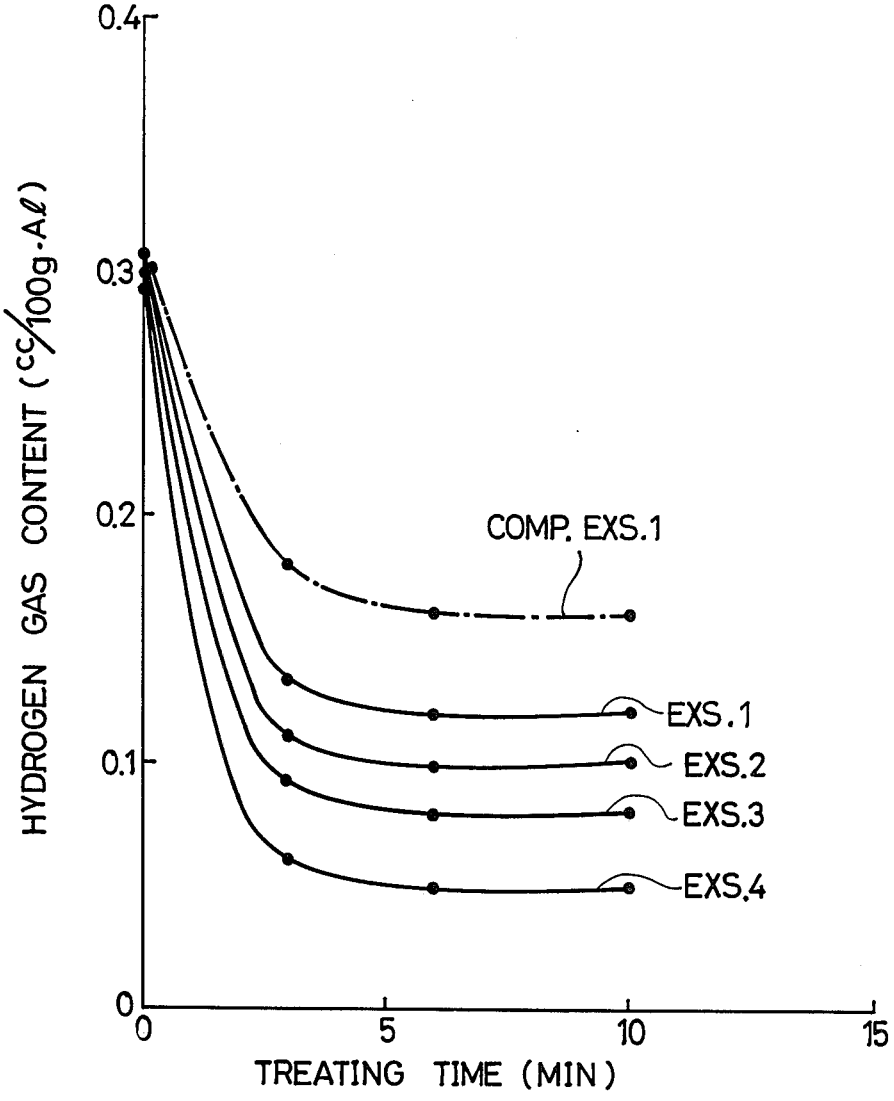
FIG. 2 is a graph showing the results achieved by Examples 1 to 4 and Comparison Example 1 to illustrate the relationship between the hydrogen gas removal treating time and the hydrogen gas content in the treated melt.

The apparatus shown in FIG. 1 was used for these examples. A 500 kg quantity of molten aluminium of 99.99 wt % purity was placed into the treating vessel 2 and maintained at 700° to 730° C. With supplying four kinds of air having the dew points listed in Table 1 through the supply pipe 14 to an atmosphere above the surface of the melt 1 (Examples 1–4) or without supplying it (Comparison Example 1), Ar gas was forced into the melt 1 at the rate of 20 l/min. through the supply channel 9 and the outlet 11 from the treating gas supply device while rotating the shaft 7 by the motor 8 at 700 r.p.m. To determine the efficiency to remove hydrogen gas from the melt 1, the hydrogen gas content in the melt 1 was measured by Telegas method. FIG. 2 shows the relationship thus established between the hydrogren gas removal treating time and the hydrogen gas content in the treated melt.

TABLE 1

| | Supplied Dry Air | |
|---|---|---|
| | Dew Point | Supply Amount |
| Ex. | | |
| 1 | −26° C. | 15 l/min |
| 2 | −41° C. | " |
| 3 | −53° C. | " |
| 4 | −70° C. | " |
| Com. Ex. | | |
| 1 | The atmosphere (dew point of 15° C.) only with no dry air supplied. | |

Examples 5–7 and Comparison Example 2

The hydrogen gas removing treatment was conducted in the same manner as in the above-mentioned Examples 1–4 and Comparison Example 1 except that a 500 kg quantity of A6063 alloy melt 1 was placed into the treating vessel 2 and that the supplied air and the dew point of the atmosphere when the examples were practiced are as shown in Table 2.

TABLE 2

| | Supplied Dry Air | |
|---|---|---|
| | Dew Point | Supply Amount |
| Ex. | | |
| 5 | −41° C. | 20 l/min |
| 6 | −51° C. | " |
| 7 | −70° C. | " |
| Com. Ex. | | |
| 2 | The atmosphere (dew point of 16° C.) only with no dry air supplied. | |

Similarly with the case of Examples 1–4 and Comparison Example 1, the relationship between the hydrogen gas removal time and the hydrogen gas content in the treated melt was determined. The result is illustrated in FIG. 3 all together.

Figure 3:
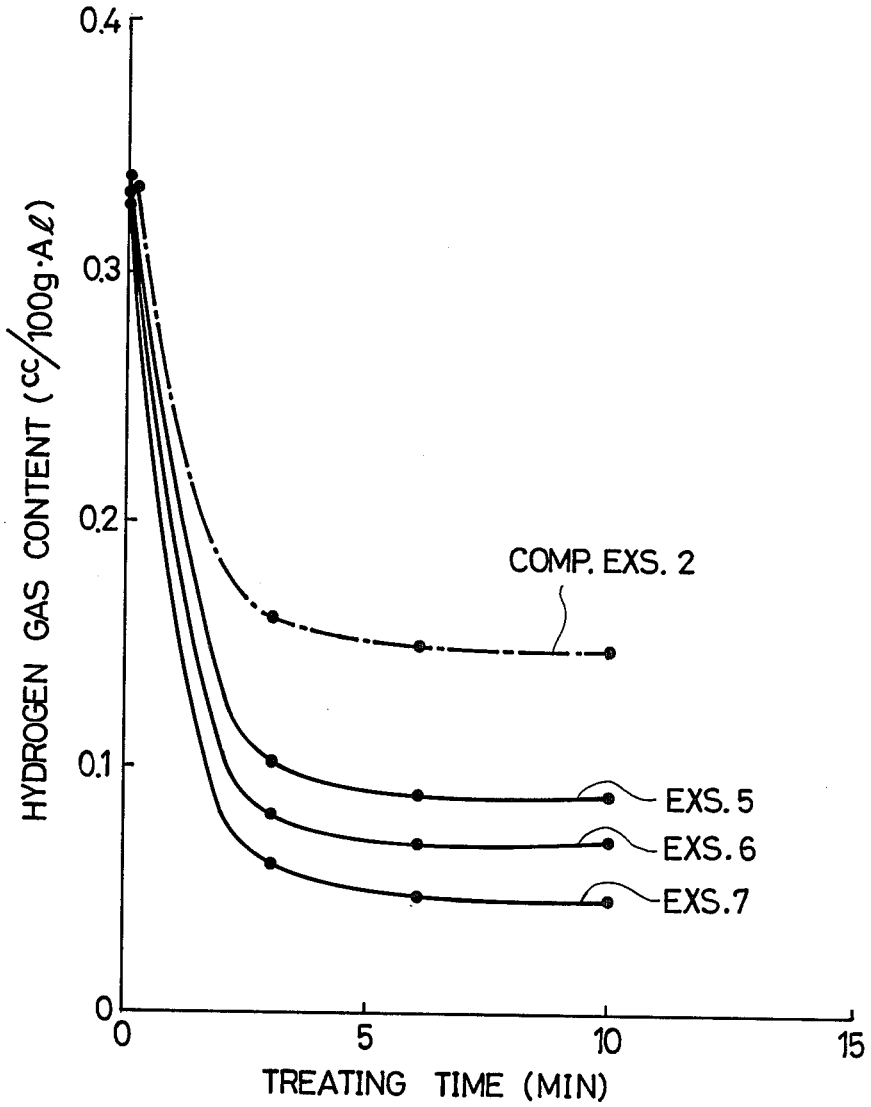
FIG. 3 is a graph showing the results achieved by Examples 5 to 7 and Comparison Example 2 to illustrate like relationship.

Apparently from FIGS. 2 and 3, in the case where the hydrogen gas removing treatment is carried out while supplying dry air to an atmosphere above the melt 1 in the treating vessel 2, the removal efficiency is remarkably improved when compared with the case where the hydrogen gas removing treatment is effected in the atmosphere. It is further noted that the lower the dew point of the dry air to be supplied or the less the water content in the dry air, the higher the hydrogen gas removal efficiency.

What is claimed is:

1. A process for treating molten aluminum to remove hydrogen gas and non-metallic inclusions therefrom comprising the steps of (a) providing an atmosphere of air having a dew point of −26° C. or below, above the surface of molten aluminum in a treating vessel where molten aluminum is placed, and maintaining said atmosphere of air at the lowered dew point, (b) introducing a dry treating gas into the molten aluminum, said treating gas being selected from at least one of the following; argon, helium, krypton, xenon, nitrogen, and chlorine and (c) removing floating non-metallic inclusions and treating gas containing hydrogen gas from the surface of the melt.

2. A process as defined in claim 1 wherein the air in said atmosphere has a dew point of below −30° C.

3. A process as defined in claim 1 wherein the air in said atmosphere has a dew point of below −50° C.

4. A process as defined in any one of claims 1 to 3 wherein the treating gas is introduced into the molten aluminum by preparing a treating gas injector comprising a rotary shaft and a rotor fixed to the lower end of the rotary shaft, the rotary shaft being immersed in the molten aluminum and having an internal treating gas supply channel, the rotor having a treating gas outlet in communication with the gas supply channel, and rotating the rotor while supplying the treating gas to the gas supply channel to force out the treating gas from the gas outlet into the molten aluminum.

5. A process as defined in any one of claims 1 to 3 wherein the air having a lower dew point than that of the atmosphere obtained by compressing the atmosphere and passing the compressed atmosphere through a dehumidifier containing a drying agent.

6. A process as defined in claim 5 wherein the drying agent is synthetic zeolite.

* * * * *